US007224814B2

(12) United States Patent
Cross et al.

(10) Patent No.: US 7,224,814 B2
(45) Date of Patent: May 29, 2007

(54) TWO-WAY COMMUNICATION DEVICE

(76) Inventors: Bryan Paul Cross, 34 Harewood Road, Doncaster, South Yorkshire DN2 6DF (GB); John Anthony Moran, 50 Messingham Lane, Scawby, Brigg, North East Lincolnshire DN20 9AZ (GB)

( * ) Notice: Subject to any disclaimer, the term of this patent is extended or adjusted under 35 U.S.C. 154(b) by 223 days.

(21) Appl. No.: 10/476,715

(22) PCT Filed: May 1, 2002

(86) PCT No.: PCT/GB02/02021

§ 371 (c)(1),
(2), (4) Date: Jun. 24, 2004

(87) PCT Pub. No.: WO02/091794

PCT Pub. Date: Nov. 14, 2002

(65) Prior Publication Data

US 2004/0234086 A1 Nov. 25, 2004

(30) Foreign Application Priority Data

May 5, 2001 (GB) ..... 0111089.9

(51) Int. Cl.
*H04R 25/00* (2006.01)
*H04R 1/00* (2006.01)

(52) U.S. Cl. ..... 381/190; 381/417

(58) Field of Classification Search ..... 381/190, 381/406, 412, 417, 419; 310/26; 335/278, 335/279, 296, 298, 299, 302
See application file for complete search history.

(56) References Cited

U.S. PATENT DOCUMENTS

| | | | | |
|---|---|---|---|---|
| 4,129,851 | A | 12/1978 | Podgorski | |
| 4,703,464 | A | 10/1987 | Howarth et al. | |
| 5,739,600 | A * | 4/1998 | Kobayashi et al. | 310/26 |
| 6,137,889 | A * | 10/2000 | Shennib et al. | 381/328 |
| 6,332,029 | B1 * | 12/2001 | Azima et al. | 381/152 |

FOREIGN PATENT DOCUMENTS

FR 2 340 014 8/1977

OTHER PUBLICATIONS

Testardi, L.R. et al., "Electromagnetic-Sound Conversion by Linear Magnetostriction in T1FEF3," Solid State Communications, Oxford, GB, vol. 7, No. 1, Jan. 1969, pp. 241-243 (ISSN: 0038-1098).

* cited by examiner

*Primary Examiner*—Sinh Tran
*Assistant Examiner*—Brian Ensey
(74) *Attorney, Agent, or Firm*—Fay Sharpe LLP

(57) ABSTRACT

A two-way communication device includes a magnetoelastic rod located between an inertial back mass and a front panel of low mass. A coil is located in the vicinity of the rod, and the rod and coil together define an audio-electric transducer. An electronic processing circuit ensures that an audio-electric signal input to the device is applied to the coil to produce a sound wave from the low mass front panel and that when a sound wave impinges on the low mass front panel an audio-electric signal is produced and output from the device.

20 Claims, 1 Drawing Sheet

TWO-WAY COMMUNICATION DEVICE

FIELD OF INVENTION

The present invention relates to magnetostrictive transducers and, more specifically, to a two-way communication device or intercom comprising a magnetostrictive transducer. The magnetostrictive transducer operates in a transmission mode to convert electrical audio signals into sound waves and in a reception mode to convert audio signals into electrical audio signals.

BACKGROUND

It is known to provide two-way communication devices or intercoms for a wide variety of uses and applications, but generally they allow communication between two parties across a secure barrier. For example, these devices find application at entry points to homes and flats, in banks where they facilitate communication between bank tellers and customers and in public telephones. By virtue of their very application, two-way communication devices are usually located in public places. Consequently, they are required to be vandal proof and weatherproof.

Conventional two-way communication devices typically comprise loudspeakers, microphones and switches housed within a robust outer casing having apertures in the front face to allow sound waves to enter and leave the device and to locate the switches. Often, attacks by vandals on these devices involve objects being pushed through these apertures to damage or destroy the loudspeaker and microphone diaphragms or to jam the switches. Other attacks can take the form of various liquids such as chewing gum, vomit or super glue introduced through the apertures causing a variety of malfunctions.

SUMMARY

It is an object of the present invention to provide a two-way communication device which is not vulnerable to physical attack.

It is yet another object of the present invention to provide a two-way communication device which does not require apertures to be formed in the outer casing thereof for the transmission of sound waves to and from the audio transducers located within the outer casing.

It is still another object of the present invention to provide a two-way communication device comprising an audio transducer which combines the functions of loudspeaker and microphone.

These objects are achieved by providing a two-way communication device comprising an audio transducer connected to a panel or face of the outer casing which operates as a diaphragm thereby converting sound waves into electrical signals at the output of the audio transducer and vice versa. Conveniently, the front panel of the outer casing forms the diaphragm.

According to the present invention there is provided a two-way communication device comprising a magnetoelastic rod located between an inertial back mass and a front panel of low mass, a coil located in the vicinity of the said rod, the rod and coil together defining an audio-electric transducer, and electronic processing means whereby an audio-electric signal input to the device is applied to the coil to produce a sound wave from the said low mass panel and a sound wave impinging on the said low mass panel produces an audio-electric signal which is output from the device.

Preferably, the magnetoelastic rod is comprised of a magnetostrictive material, such as Terfenol with a typical constitution of $Tb_{0.3}Dy_{0.7}Fe_{1.95}$.

It is known within the prior art to provide loudspeakers which are based on the magnetostrictive effect. For the purposes of explanation and clarification the magnetostrictive effect is the property of certain materials to undergo a geometrical modification, e.g. contraction, expansion, bending, twisting, etc., when subjected to the influence of a magnetic field. Metal alloys and more specifically ferromagnetic compounds are magnetostrictive materials.

French Patent No. 7702333 discloses a magnetostrictive device which operates as a loudspeaker to convert electrical signals into sound waves. Essentially the device comprises a bar of magnetostrictive material arranged within a coil. When a varying voltage is applied to the coil it produces a magnetic field which causes the magnetostrictive bar to expand or contract. At each of the ends of the magnetostrictive bar, this produces an elastic wave. By connecting one or each end of the magnetostrictive bar to a diaphragm this elastic wave can be converted into sound waves corresponding to the electrical signal applied to the coil.

Preferably, the said low mass panel is defined by the front panel of an outer casing. Alternatively, the front panel may form a solid surface to which the audio transducer is mounted. Conveniently, the said low mass panel is comprised of stainless steel or some other strong, yet flexible material. The present invention ensures that damage to the internal workings of the device is prevented by presenting an outer casing which has no accessible apertures in it and which presents the appearance of a plain, unbroken sheet of solid stainless steel.

In one embodiment of the present invention a single coil is provided in the vicinity of magnetoelastic rod which simultaneously carries the electrical signals corresponding to audio-out and audio-in. These two signals are separated within the said processing means. However, as an alternative to this a first drive coil may be provided in the vicinity of the magnetoelastic rod which carries the electrical signal corresponding to the audio-out and a second high-turn sense coil may be provided, again within the vicinity of the magnetoelastic rod, which carries the electrical signal corresponding to the audio-in. As yet a further alternative, the sense coil may be replaced with flux sensor that relies on changes in the magneto resistance of the circuit or the Hall effect to provide an electrical output corresponding to the audio-in.

Preferably, the magnetoelastic rod is biased into the linear region of its response characteristic by positioning a permanent magnet in proximity thereto. As an alternative to this a DC voltage may be applied to the drive coil to bias the magnetoelastic rod into this region.

Preferably, the electronic processing means comprises means for detecting electrical impulses in the coil having a rate of change in excess of a predetermined value, corresponding to the low mass panel being touched. This allows the device to provide a switch facility which may be used, for example, to operate an audible or visual device to attract attention.

In addition to operating the magnetoelastic rod to cause the low mass panel to vibrate and generate a sound wave, the magnetic field generated by the coil allows the electrical audio-out signal to be picked up by hearing aids. This coupling facility is, of course, useful to those with impaired hearing.

Conveniently, the electronic processing means incorporating audio drive, audio sense electronics, and touch detecting circuits is incorporated into the inertial core of the magnetoelastic transducer.

The two-way communication device of the present invention integrates the functions of loudspeaker, microphone and, optionally, switch and hearing aid coupler in a single transducer which is enclosed in a casing that can be small, rugged, vandal resistant and hermetically sealed.

BRIEF DESCRIPTION OF DRAWINGS

An embodiment of the present invention will now be described, by way of example, with reference to the accompanying drawings, in which.

DETAILED DESCRIPTION

Figure 1:
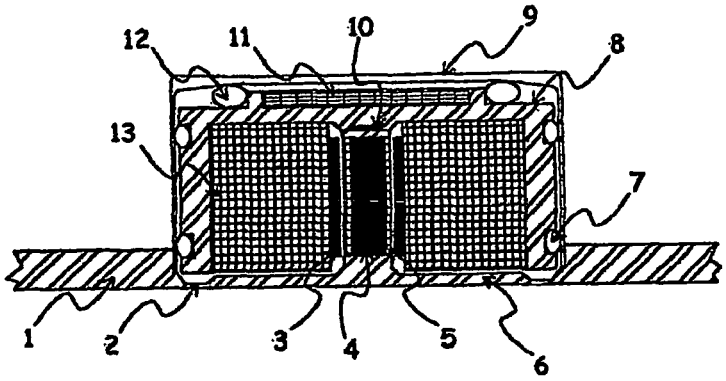
FIG. 1 is a cross-sectional view through a two-way communication device embodying the present invention.

Referring to FIG. 1 of the drawings there is shown in cross-section a two-way communication device or intercom embodying the present invention. The device comprises an outer casing 9, housing an audio transducer comprising a rod 4 of magnetostrictive material, a drive coil 13 and a sense coil 5. Both the drive coil 13 and the sense coil 5 are coiled around the rod 4. The rod 4 is held between an inertial back mass 8 and a front panel 1 of the device and, more specifically, a flexible diaphragm 6 formed in and integral with the front panel 1. The diaphragm 6 is supported within the front panel 1 on flexural supports 2. As will be explained in greater detail herein below the audio transducer operates as both a loudspeaker and as a microphone with sound waves being generated by the diaphragm 6 in response to audio-out signals and sound waves being picked up by the diaphragm 6 to generate an audio-in signal.

A tubular permanent magnet 3 surrounds the rod 4 and the sense coil 5. This permanent magnet 3 serves to bias the magnetostrictive material comprising the rod 4 into the linear region of its response characteristic. As an alternative to providing a permanent magnet, however, this can be achieved by connecting a DC biasing voltage to the drive coil 13. The audio signal processing circuits associated with the device are provided on a circuit board 11 mounted on the back of the inertial mass 8.

The recess defined by the outer case 9 is dimensioned so as to ensure that the transducer is positioned at a precise distance from the diaphragm 6. The outer case 9 provides a means to hold and align the inertial mass 8 via 'O' rings (7). Finally, a pre-stress spring 12 is located between the outer case 9 and the inertial mass 8 which serves to maximise the strain in the magnetostrictive rod 4.

In use, an audio-in signal applied to the drive coil 13 produces a fluctuating magnetic field around the rod 4 which causes it to expand and contract. This in turn causes the diaphragm 6 to vibrate and produce a sound wave corresponding to the audio-in signal. The same diaphragm 6 is also responsive to sound waves impinging thereon to vibrate and to cause the rod 4 to change in length in response thereto. As the length of the rod 4 fluctuates this generates a fluctuating magnetic field which in turn creates a fluctuating electrical signal in the drive coil 13. Using appropriate circuitry such as that shown in and described with reference to FIG. 2 hereinbelow, the electrical audio-in and audio-out signals in the drive coil 13 can be processed. However, as an alternative to using the one coil 13 to both drive the diaphragm and to sense vibration thereof, the device as shown in FIG. 1 comprises a dedicated high-turn sense coil 5. Yet another way of detecting changes in the magnetic flux of the rod 4 caused by sound waves impinging on the diaphragm 6 is to use a flux sensor 10. In practice, only one of these three means is likely to be used at any one time.

The rod 4 of magnetostrictive material may be comprised of Terfenol with a typical composition of $Tb_{0.3}Dy_{0.7}Fe_{1.95}$ for example, or similar material with similar properties. A material of this kind is chosen for its efficient conversion of magnetic to mechanical energy and vice versa. Applying a mechanical pre-stress using the springs 12 and magnetic bias field using the permanent magnet 3 optimises the material performance. The springs 12 also provide shock protection to the magnetostrictive material. As shown in FIG. 1 the inertial mass 8 is suspended in the outer case 9, using high compliance 'O' rings. However in another embodiment the inertial mass can be replaced by the mass of the outer casing 9 itself.

The assembled transducer is integrated into the solid front panel of the relevant product to produce a solid and robust unit that will be resistant to physical abuse and present a solid unbroken external surface. An alternative embodiment will have the transducer manufactured as a separate entity, which can then be mounted into a solid surface that will act both as a receiver and transmitter of sound. Depending on the application, the transducer front panel can be bonded or screwed to a mounting surface. Irrespective of the mounting method, no holes are required in the front panel and the unit is therefore immune to typical vandal attacks such as poking and gluing.

As shown in FIG. 1 the rod 4 is directly coupled to the steel front panel 1 so that the acoustic matching is good. In other embodiments acoustic matching is provided by, for example, matching layers or acoustic impedance transformers familiar to those versed in the art.

Integral to the successful embodiment of audio-in and audio-out in a single device is an electronic subsystem comprising coil drivers, audio amplifiers and detection circuits. Because both the audio drive and receive signals are coupled by the magnetostrictive material, means have to be provided for separating these signals to prevent acoustic feedback.

Figure 2:
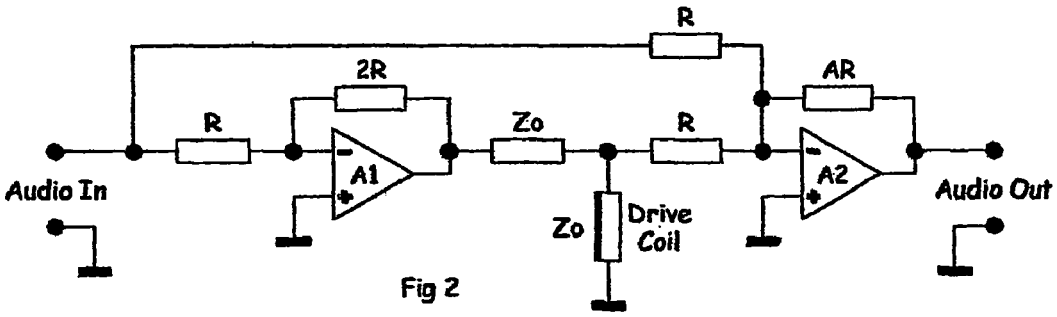
FIG. 2 is a circuit diagram of an audio signal processor circuit suitable for use in a two-way communication device according to the present invention comprising a single coil; and, FIG. 3 is a circuit diagram of a voltage threshold detector for use in a two-way communication device according to the present invention.

Referring to FIG. 2 of the drawings there is shown an electronic hybrid circuit which is able to separate the transmit (loudspeaker) and receive (microphone) signals, thereby preventing acoustic feedback. Operational amplifier A1 simply provides a gain of ×2 to the 'Audio-In' signal obtained from a source external to the device itself. This compensates for the reduction of the output of A1 to ½ caused by the potential divider formed by the impedance matching Zo and the 'Drive Coil' Zo. Thus the drive signal level at the 'Drive Coil' is equal to 'Audio-In' in amplitude, but has been inverted by A1. A non-inverted copy of 'Audio-In' is mixed with the inverted signal at the input to operational amplifier A2. The operation of A2 is to cancel both signals so eliminating 'Audio-In' from the output of A2. The final function of A2 is to amplify the output of the 'Drive Coil' that is generated in microphone mode by a factor of AR/R=A.

Figure 3:
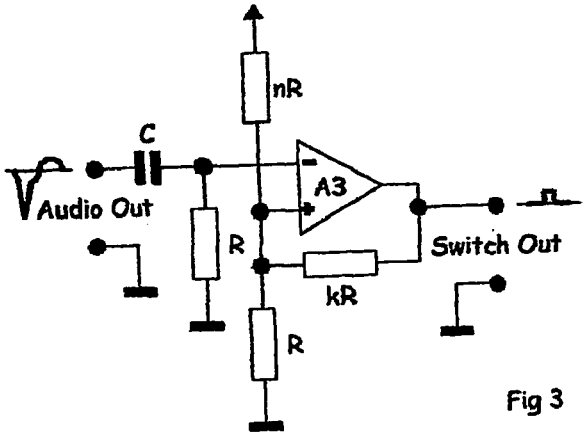

Referring now to FIG. 3 there is shown a voltage threshold detector circuit which consists of a differentiator and a Schmitt trigger. The input signal applied to this circuit is the 'Audio-Out' signal obtained from the circuit of FIG. 2. With normal speech signals as the input to the drive coil the 'Audio-Out' signal will have a limited rate of change of voltage. However, when the diaphragm is tapped sharply, the rate of change of the resulting output signal from the drive coil will be much greater and the amplitude will generally be greater. This signal will be passed preferentially through capacitor C and presented to the input of the operational amplifier A3. Since this transient signal will be negative going, the −ve input to A3 is biased at a suitable −ve level that will not respond to small, low rate-of-change signals. This threshold level is set by the ratio of R/(R+nR). The resistor kR provides a degree of hysteresis to provide a 'clean' signal at 'Switch Out'.

It will be apparent from the description given above that the present invention provides a highly integrated multi-functional audio transducer that provides means for transmitting and receiving sound, and optional acting as a control switch input. A further advantage of the invention is that the magnetic field generated in the drive coil can be coupled to hearing aids. All of these functions are provided in a single audio transducer which is operatively connected to a diaphragm formed as an integral part of a stainless steel sheet front panel that has no external apertures or electrical connections that would make the unit vulnerable to attack.

The invention claimed is:

1. A two-way non-resonant audio communication device for use in air comprising a magnetoelastic rod located between a freely vibrating inertial back mass and a freely vibrating front panel of low mass, a coil located in the vicinity of the said rod, the rod and coil together defining an audio-electric transducer, and electronic processing means whereby an audio-electric signal input to the device is applied to the coil to produce a sound wave from said low mass front panel and a sound wave simultaneously impinging on said low mass front panel produces an audio-electric signal which is output from the device.

2. A two-way communication device according to claim 1, wherein the magnetoelastic rod is comprised of a magnetostrictive material.

3. A two-way communication device according to claim 2, wherein the magnetostrictive material is Terfenol with a typical constitution of $Tb_{0.3}Dy_{0.7}Fe_{1.95}$.

4. A two-way communication device according to claim 1, wherein the said low mass front panel is defined by an outer casing.

5. A two-way communication device according to claim 1, wherein said low mass front panel comprises a solid surface adjacent to which the audio-electric transducer is mounted.

6. A two-way communication device according to claim 1, wherein said low mass front panel is comprised of stainless steel.

7. A two-way communication device according to claim 1, wherein a single coil is provided in the vicinity of magnetoelastic rod which simultaneously carries the electrical signals corresponding to audio-out and audio-in and means are provided within the said processing means for separating these signals.

8. A two-way communication device according to claim 1, wherein a first drive coil is provided in the vicinity of the magnetoelastic rod which carries an audio-out electrical signal and a second high-turn sense coil is provided, again within the vicinity of the magnetoelastic rod, which carries an audio-in electrical signal.

9. A two-way communication device according to claim 1, wherein a first drive coil is provided in the vicinity of the magnetoelastic rod which carries an audio-out electrical signal and a flux sensor that relies on changes in magneto resistance or the Hall effect to provide an audio-in electrical signal.

10. A two-way communication device according to claim 1, wherein the magnetoelastic rod is biased into the linear region of its response characteristic by positioning a permanent magnet in proximity thereto.

11. A two-way communication device comprising a magnetoelastic rod located between an inertial back mass and a front panel of low mass, a coil located in the vicinity of the said rod, the rod and coil together defining an audio-electric transducer, and electronic processing means whereby an audio-electric signal input to the device is applied to the coil to produce a sound wave from the low mass front panel and a sound wave impinging on the said low mass front panel produces an audio-electric signal which is output from the device, wherein a DC voltage is applied to the coil to bias the magnetoelastic rod into a linear region of its responsive characteristic.

12. A two-way communication device comprising a magnetoelastic rod located between an inertial back mass and a front panel of low mass, a coil located in the vicinity of the said rod, the rod and coil together defining an audio-electric transducer, and electronic processing means whereby an audio-electric signal input to the device is applied to the coil to produce a sound wave from the low mass front panel and a sound wave impinging on the said low mass front panel produces an audio-electric signal which is output from the device, wherein the electronic processing means comprises means for detecting electrical impulses in the coil having a rate of change in excess of a predetermined value, corresponding to the low mass front panel being touched.

13. A two-way communication device comprising a magnetoelastic rod located between an inertial back mass and a front panel of low mass, a coil located in the vicinity of the said rod, the rod and coil together defining an audio-electric transducer, and electronic processing means whereby an audio-electric signal input to the device is applied to the coil to produce a sound wave from the low mass front panel and a sound wave impinging on the said low mass front panel produces an audio-electric signal which is output from the device, wherein a magnetic field generated by the coil allows the audio-electric signal which is output from the device to be picked up by hearing aids.

14. A two-way communication device comprising a magnetoelastic rod located between an inertial back mass and a front panel of low mass, a coil located in the vicinity of the said rod, the rod and coil together defining an audio-electric transducer, and electronic processing means whereby an audio-electric signal input to the device is applied to the coil to produce a sound wave from the low mass front panel and a sound wave impinging on the said low mass front panel produces an audio-electric signal which is output from the device, wherein the electronic processing means comprises audio drive, audio sense electronics, and wherein touch detecting circuits are incorporated into the inertial mass of the magnetoelastic transducer.

15. A two-way communication device according to claim 2, wherein the said low mass front panel is defined by an outer casing.

16. A two-way communication device according to claim 3, wherein the said low mass front panel is defined by an outer casing.

17. A two-way communication device according to claim 2, wherein the said low mass front panel comprises a solid surface to which the audio-electric transducer is mounted.

18. A two-way communication device according to claim 3, wherein the said low mass front panel comprises a solid surface adjacent to which the audio-electric transducer is mounted.

19. A two-way communication device according to claim 2, wherein a first drive coil is provided in the vicinity of the magnetoelastic rod which carries an audio-out electrical signal and a second high-turn sense coil is provided, again within the vicinity of the magnetoelastic rod, which carries an audio-in electrical signal.

20. A two-way non-resonant human voice communication device for use in air, said device comprising:

a magnetoelastic rod located between a freely vibrating inertial back mass and a freely vibrating front panel of low mass;

a coil located in the vicinity of said rod, the rod and coil together defining an audio-electric transducer; and, an electronic processor operative to control said device so that an audio-electric signal input to the device is applied to the coil to produce a sound wave from said low mass front panel and a sound wave simultaneously impinging on the said low mass front panel produces an audio-electric signal which is output from the device.

* * * * *